United States Patent [19]

Allen

[11] Patent Number: 4,809,400

[45] Date of Patent: Mar. 7, 1989

[54] SECURITY HARDWARE FOR DOORS

[76] Inventor: Mark L. Allen, 1776 E. 13th St., Brooklyn, N.Y. 11229

[21] Appl. No.: 151,102

[22] Filed: Feb. 1, 1988

Related U.S. Application Data

[63] Continuation-in-part of Ser. No. 24,301, Mar. 10, 1987, Pat. No. 4,771,506.

[51] Int. Cl.[4] ..... E05F 5/00; E05B 15/02; E05D 11/00; E05D 11/10

[52] U.S. Cl. ..... 16/82; 16/251; 16/319; 70/451; 292/340

[58] Field of Search ..... 16/82, 251, 382, 384, 16/390, 391; 70/451; 292/340

[56] References Cited

U.S. PATENT DOCUMENTS 4,547,009 10/1985 Allen ..... 16/251

4,656,691 4/1987 Allen ..... 16/251

4,763,499 8/1988 Boyle ..... 70/451

*Primary Examiner*—Nicholas P. Godici

*Assistant Examiner*—William Scott Andes

*Attorney, Agent, or Firm*—William P. Keegan

[57] ABSTRACT

Security hardware for an exterior entry door in which a flat piece of metal is bent into a J-shaped door jamb mounted component and in which an aperture through which a door mounted article of hardware can project is provided in the single layer part an aligned buck pin apertures are provided in the double layer part of the component. A buck pin having a head portion and a grooved portion spaced therefrom is also provided as is a slotted retaining member that when positioned between the double layer of the component engages the grooved portion of the buck pin to prevent its removal from the buck pin apertures.

7 Claims, 4 Drawing Sheets

SECURITY HARDWARE FOR DOORS

FIELD OF THE INVENTION

This invention is a continuation-in-part of application Ser. No. 024,301 filed Mar. 10, 1987, now U.S. Pat. No. 4,771,506.

This invention relates to hardware for doors, and more particularly to hardware for exterior entry doors that improves the security offered by such doors by minimizing the likelihood of the door hinges or strike being ripped from the door frame when a force is applied against the outside surface of the door.

BACKGROUND OF THE INVENTION

My earlier patents, U.S. Pat. Nos. 4,547,009 and 4,656,691, disclose door hardware such as strikes and hinges that are securely anchored in the wall structure surrounding the door frame and thus resist being ripped from the door frame when a force is applied to the outside surface of the door, either at the lock or hinge edge of the door. The hardware is mounted on the door frame and it includes a segment that extends beyond the outside surface of the door and an integral buck pin that projects inwardly from the segment through the door frame and into the underlying wall structure. Thus, if the hardware is a strike, it will be anchored by the buck pin a substantial distance from the inside edge of the door frame where the ordinary strike is secured and susceptible to being ripped from the frame by a force applied to the door, and through the lock bolt to the strike. In a similar way, the jamb leaf of a hinge includes a segment that extends beyond the outside surface of the door and includes a buck pin that projects into the underlying wall structure. Thus, there is less likelihood than with an ordinary hinge, of the jamb leaf being ripped from the door frame by a force applied against the door at its hinge side.

BRIEF SUMMARY OF THE INVENTION

It is an object of the invention to provide improved door hardware that enhances the security offered by an entry door.

It is another object of the invention to provide security hardware that is simple and inexpensive to manufacture.

It is still another object of the invention to provide adjustable door hardware that can be accommodated to door frames of varying depth.

In carrying out the invention, a strike or security device includes a door frame mounted element that is formed from a flat piece of steel that is bent into a J-shape with a pair of aligned buck pin apertures provided in the overlapping spaced apart portion of the element. A separate buck pin having a head portion and an annular groove formed therein is inserted through the apertures and into the wall structure beyond the door frame so that the annular groove is positioned in the space between the overlapping portion of the J-shaped element. A retaining plate slipped into the space between the overlapping portion of the J-shaped element engages the annular groove in the buck pin and prevents its removal. The J-shaped element is further provided with an aperture through which the bolt of a door mounted lock or a door mounted plate may extend. The J-shaped element may comprise two parts, a U-shaped channel member and a flat plate that adjustably overlaps the channel member so that the length of the element may be varied.

Features and advantages of the invention may be gained from the foregoing and from the description of a preferred embodiment of the invention which follows.

DETAILED DESCRIPTION OF THE INVENTION

Figure 1:
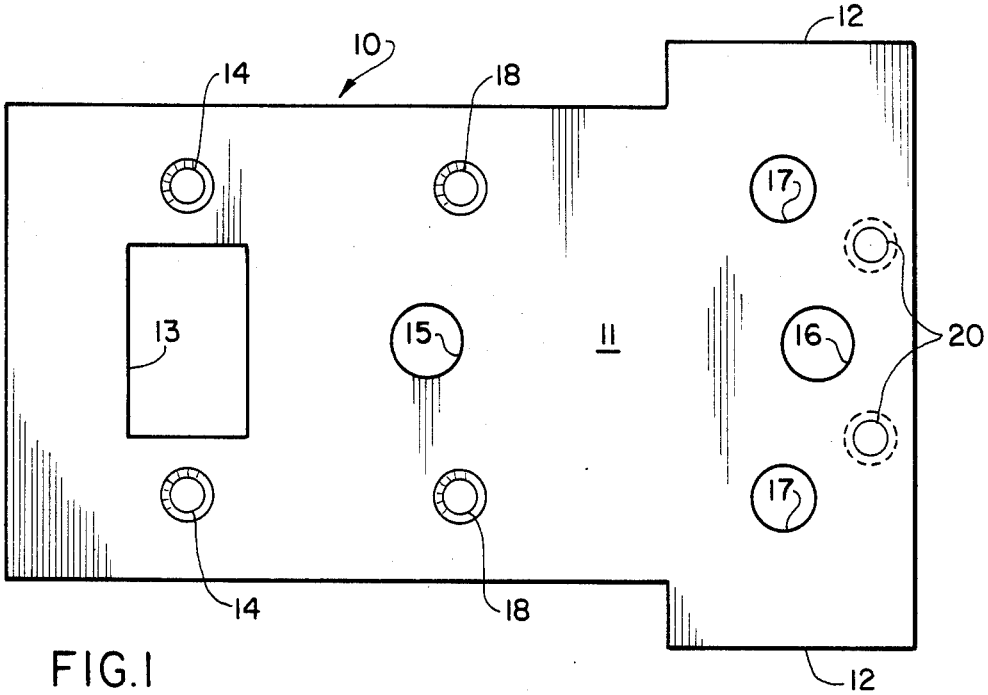
FIG. 1 is an elevational view of a steel blank from which a strike is formed

Referring to the drawing, a strike 10 is formed from a strike plate blank 11. The blank 11 is generally of rectangular form and comprises a flat piece of steel or any other suitable foldable material. It may be provided with optional tabs 12. While in its flat unfolded state, blank 11 is provided with the various apertures and screwholes found in the finished strike 10. Thus, there is the bolt aperture 13 which is usually of a rectangular shape, but which could be otherwise to accommodate the bolt provided in the door lock to be used with the strike. Countersunk screwholes 14 and 18 are provided for screws that will secure strike 10 to a door jamb. The buck pin apertures 15 and 16 are provided as shown, as are clearance holes 17 which enable a screwdriver to access screws to be driven through screwholes 18 when strike 10 is secured to a door jamb. An additional screw or a pair thereof, may be provided for a purpose later to be described. If provided, screw holes 20 are countersunk from the reverse side of blank 11.

Figure 3:
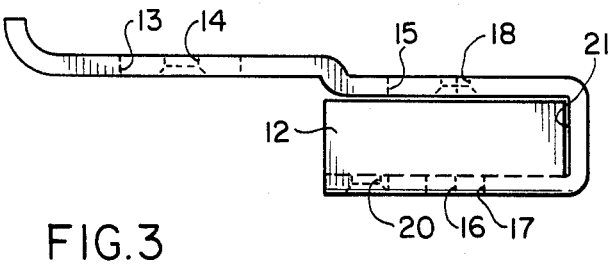
FIG. 3 is a top plan view of the strike of FIG. 2.
Figure 5:
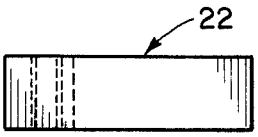
FIG. 5 is a top plan view of the retaining plate.
Figure 2:
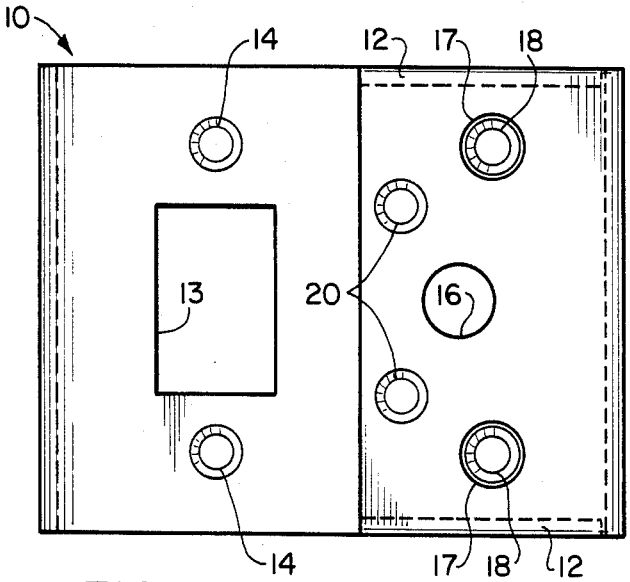
FIG. 2 is an elevational view of a strike formed from the blank of FIG. 1.

FIG. 2 shows blank 11 folded into its finished form as strike 10. It will be noted that when blank 11 is folded, buck pin apertures 15 and 16 are aligned as are clearance holes 17 and screwholes 18. Optional tabs 12 are shown folded in FIGS. 2 and 3. The tabs, if provided, close the open ends of the cavity 21 formed by the folded blank, and thus they serve an aesthetic purpose.

Their omission will not affect the security provided by strike 10.

In addition to the folded strike plate 11, strike 10 includes a retaining member 22 and a buck pin 23. Referring to the latter first, buck pin 23 is formed from a steel bar or rod that will closely fit apertures 15 and 16. The length of buck pin 23 is sufficient to reach through an aperture drilled through a door jamb and into the wood studs or masonry forming the wall structure beneath the door frame. At one end, buck pin 23 is provided with an annular groove 24 and a head 25. Since, as will later be seen, head 25 will be exposed to any attempt to violate the security offered by strike 10, buck pin 23 and head 25 will be sized, and of a material, to withstand an assault by a hammer and cold chisel. The retaining member 22 is a rectangular piece of steel having an elongated slot 26 that, after buck pin 23 is inserted through apertures 15 and 16, enables member 22 to be slipped into cavity 21 around annular groove 24. When so placed, retaining member 22 prevents the withdrawal of buck pin 23 from apertures 15 and 16 of strike 10. After retaining member 22 is in place, optional machine screws 85 (FIG. 16) may be screwed through screwholes 20 and into aligned threaded holes provided in member 22. Since these screws would be accessible outside of a locked door, they do not contribute to the security of strike 10 and they together with screwholes 20 and the threaded holes in member 22 may be omitted to economize on the cost of manufacturing strike 10. In such a case, member 22 is secured in cavity 21 by the locked door and buck pin 23. They do, however, obviate the inadvertent removal of member 22 when the door is open.

Figure 4:
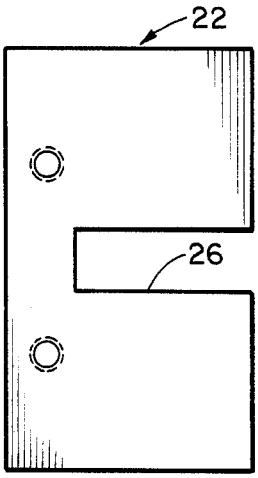
FIG. 4 is a front elevational view of a retaining plate used with the strike.
Figure 6:
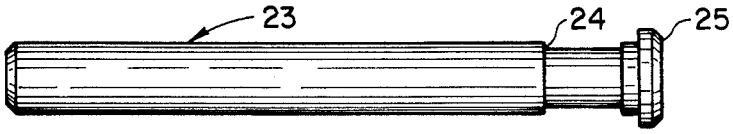
FIG. 6 is an elevational view of a buck pin.
Figure 7:
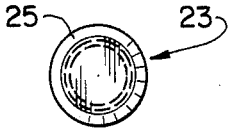
FIG. 7 is a side elevational view of the buck pin.
Figure 10:
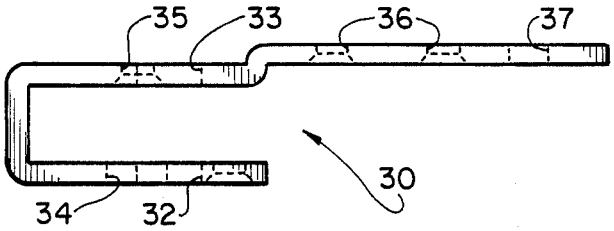
FIG. 10 is a top plan view of the device shown in FIG. 8.
Figure 9:
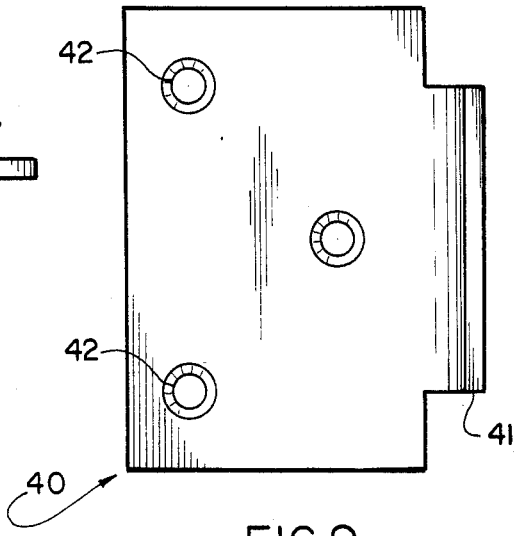
FIG. 9 is an elevational view of a door mounted plate that is used in conjunction with the device shown in FIG. 8.
Figure 8:
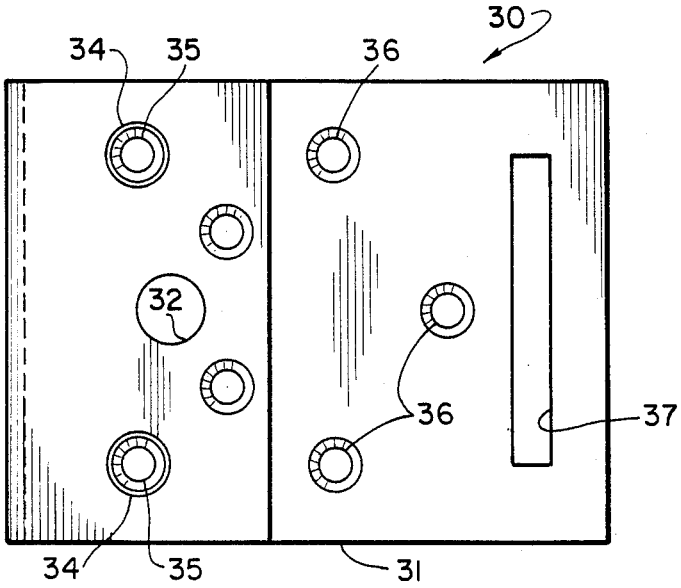
FIG. 8 is an elevational view of a door security device are to the strike of FIG. 2.
Figure 11:
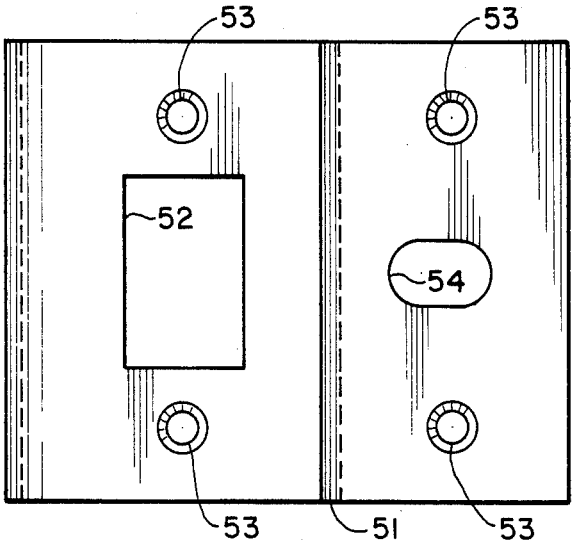
FIG. 11 is an elevational view of one piece of a two piece adjustable strike.
Figure 12:
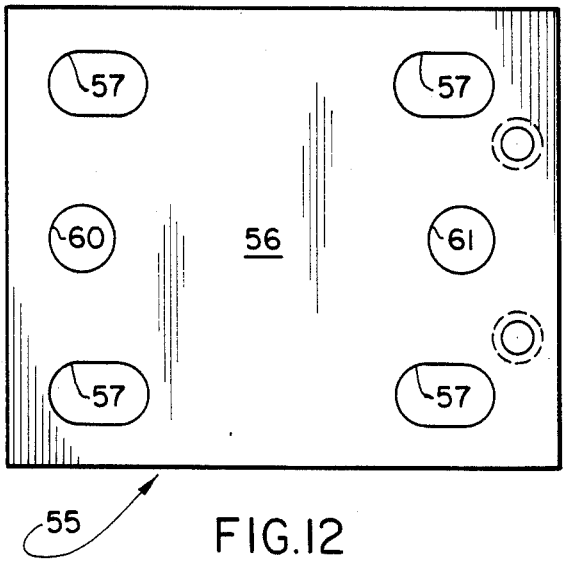
FIG. 12 is an elevational view of the blank from which the second piece of a two piece adjustable strike is formed.
Figure 14:
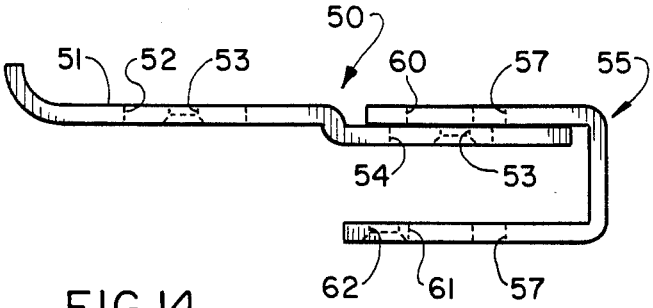
FIG. 14 is a top plan view of a two piece adjustable strike.
Figure 13:
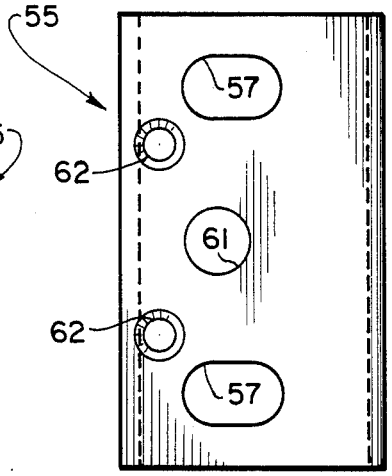
FIG. 13 is an elevational view of the second piece of a two piece adjustable strike.
Figure 15:
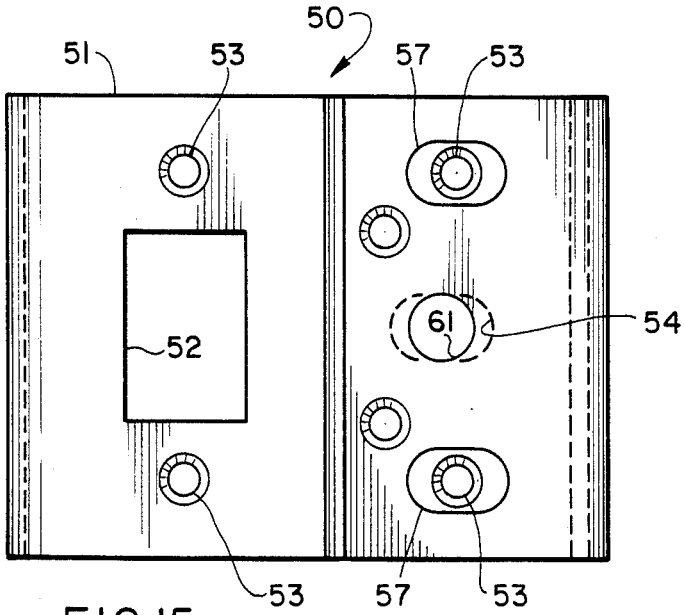
FIG. 15 is an elevational view of a two piece adjustable strike.

Referring to FIGS. 8, 9, and 10, a strike-like device 30 that minimizes the likelihood of kicking in or forcing the hinge side of a door by ripping the door hinges from the door frame is illustrated. The device 30 does not function as a hinge, but rather would be mounted on the hinge side of the door, preferably opposite the position of strike 10. The similarity of device 30 to strike 10, both in form and function, is most graphically shown in FIG. 16. Jamb element 31 is formed from a flat blank that is folded in a J-shape so that buck pin apertures 32 and 33 align with each other and clearance holes 34 provide access to screws driven through screwholes 35 when device 30 is mounted on a door jamb. Additional screwholes 36 are provided for securing the device to the door jamb. A slot 37 is provided so that a door mounted plate 40, formed with an arcuate tab 41, can engage device 30 when the door is in either an open or a closed position by extending through slot 37. Member 40 is provided with screwholes 42 by which it is mounted to the inside surface of a door. A retaining member 43 and a buck pin 44, identical to the similar articles shown in FIGS. 4 and 6, are provided for device FIGS. 10 to 15 illustrate an adjustable strike 50 in which the spacing between the bolt aperture and the buck pin apertures can be varied so that strike 50 can be used in different installations having different wall thicknesses. Here, strike 50 comprises a first plate 51 in which is provided the bolt aperture 52 and the screwholes 53 for mounting plate 51 on a door jamb. Plate 51 is also provided with an elongated slot 54 through which a buck pin similar to buck pin 23 will pass. A cover member 55 is formed from a flat steel blank 56 that is provided with clearance slots 57 and buck pin apertures 60 and 61 and then folded to form U-shaped cover member 55. Optional screwholes 62 may be provided on blank 56 so that a retaining plate, similar to member 22, can be screwed to member 55 for the purpose previously mentioned in connection with strike 10.

Figure 16:
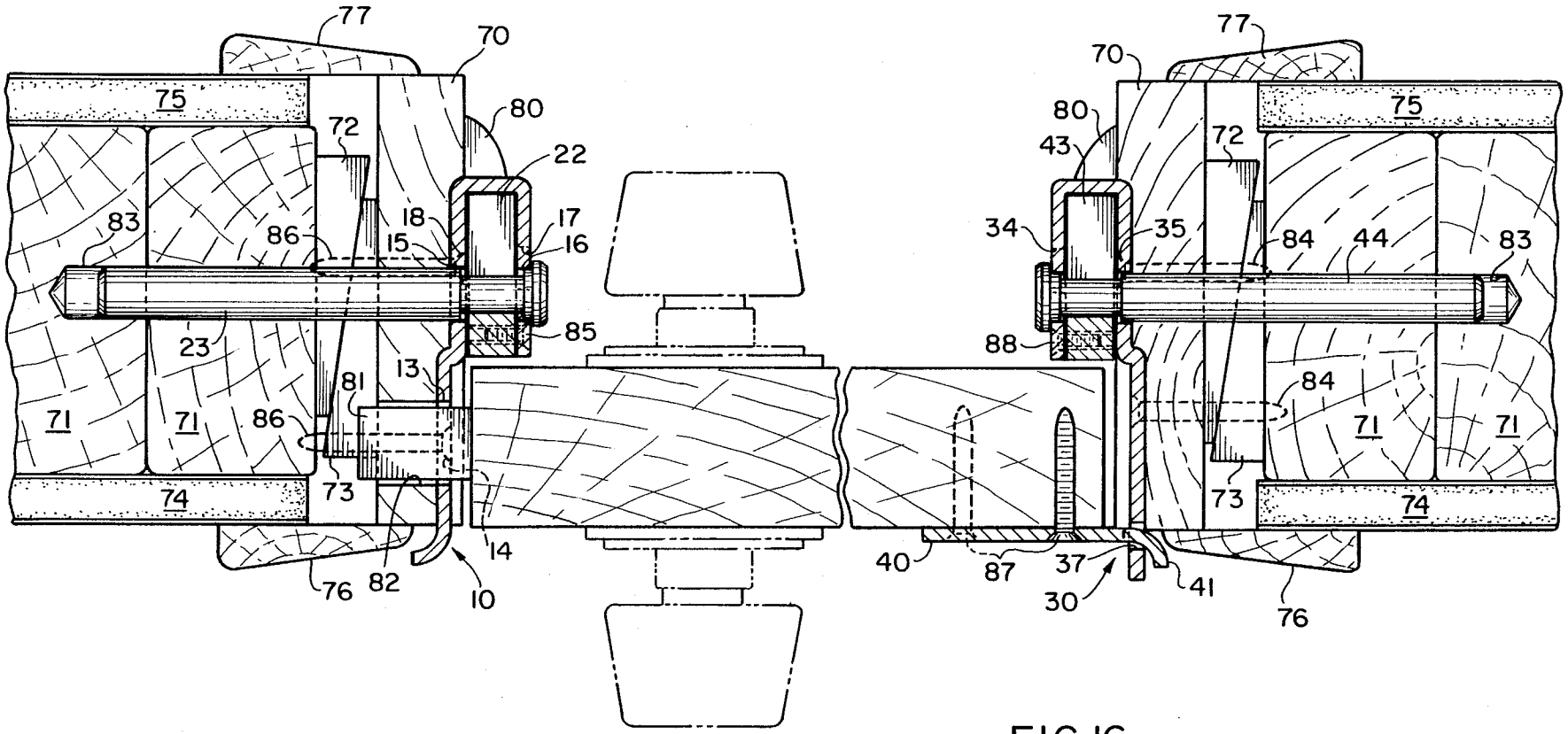
FIG. 16 is a sectional view showing the strike and the security device of the present invention as they are used to enhance the security of an entry door.

The installation and use of improved strike 10 and security device 30 is best illustrated in FIG. 16, to which reference is now made. The door jamb to which strike 10 is secured comprises a door frame member 70 which is nailed to the end stud 71 of the wall adjacent the door opening. Generally, this last stud comprises a double two by four for added strength around the door opening. Other type wall structures, such as masonry walls, may be found in some apartments, and the improved strike and security device of the present invention may also be used on door frames set in such walls The buck pins would simply project into apertures provided in the masonry instead of apertures provided in the double two by four stud.

Frame member 70 is spaced from the stud 71 by a pair of tapered spacing pieces 72 and 73 which enable member 70 to be positioned to provide the proper door opening width. The inner wall 74 and the outer wall 75 are shown as sheet rock panels. Molding strips 76 and 77 are also illustrated, as is door stop strip 80 against which the door normally abuts when in a closed position.

Of course, strike 10 will be located depending on where dead bolt 81 will enter the door frame. At that position a bolt receiving aperture 82 will be provided in frame member 70. The strike 10 is aligned such that bolt aperture 13 aligns with aperture 82. Such alignment also determines where hole 83 is provided in frame member 70 and stud 71 to receive buck pin 23. A notch is cut in door stop strip 80 and frame member 70 so that strike 10 can be mounted flush with the surface of frame member 70. Wood screws 86 will be driven through screw holes 14 and 18 into frame member 70 and stud 71. Screwdriver access to screws 86 in screw holes 18 will be through clearance holes 17. If not already provided, aperture 83 can be drilled through frame member 70 and into stud 71 using the buck pin apertures 15 and 16 in strike 10 as a guide. Buck pin 23 is then inserted through apertures 15 and 16, and into aperture 83 so that its head 25 abuts the outer surface of strike 10 and groove 24 is aligned in cavity 21. Thereafter, retaining member 22 is slipped into cavity 21 with its slot 26 closely engaging groove 24 in buck pin 23. The buck pin cannot now be withdrawn from the strike. The closed and locked door prevents the removal of retaining member 22. A small screw 85 can be provided to obviate the inadvertent removal of member 22 when the door is open.

On the hinge side of the door, it will be seen that security device 30 and door plate 40 materially strengthen that side of the door and, for all intents and purposes, minimizes the likelihood of forcing the door open on its hinge side by ripping the hinge screws of the conventional hinges supporting the door from the door jamb. Security device 30 will be secured to the door frame and studs by screws 84, and door plate 40 will be secured to the door by screws 87 so that tab 41 extends through slot 37 in device 30. A buck pin 44 and retaining plate 43 will be provided for security device 30 as in the case of strike 10, and a screw 88 may be provided to serve the same purpose that screw 85 serves in strike 10. It is to be noted that security device 30 is not a hinge that supports the door for swinging motion, but it simply an additional device that is provided on the hinge side of the door, preferably in a location midway between the top and the bottom of the door.

If the adjustable strike 50 is to be used, the first element 51 is secured to the door frame and then cover member 55 is positioned so that buck pin apertures are located in alignment with the position on the door frame where it is desired that the buck pin is to be placed. Cover member 55 is then secured to the door frame by screw driven through screwholes 53 in first element 51 and slots 57 in cover member 55. A buck pin is inserted through buck pin apertures 60 and 61 in cover member 55 and through slot 54 in first element 51. A retaining member similar to member 22 is then inserted between the two arms of member 55 to secure the buck pin in place. Slots 54 and 57 enable the strike to be adjusted for varying spacings between bolt aperture 52 and buck pin apertures 60 and 61.

Having thus described the invention, it is to be understood that many apparently different embodiments thereof can be made without departing from the spirit and scope of the invention. The strike can be adapted for different types of locks such as mortise locks and rim deadbolts. It may also be provided with a bolt box. While preferred as a security device as described, and not as a hinge, security device 30 could be a hinge with slot 37 and tab 41 replaced by the usual hinge barrels and pivot pin. Therefore, it is intended that the foregoing specification and the accompanying drawing be interpreted as illustrative rather than in a limiting sense.

What is claimed is:

1. Door security hardware for an exterior entry door mounted in a door opening having door jambs secured to a wall structure, said hardware comprising: a plate having a length greater than the thickness of a door and adapted to be mounted on a door jamb such that a first part of said plate extends beyond the outside surface of the door and a second part of said plate extends inwardly therefrom adjacent the edge of a door mounted in the door opening, said second part of said plate being formed with an aperture through which a door mounted article of hardware can project, and said first part of said plate being formed by folding a flat portion of said plate into an inner segment and an outer parallel segment spaced from said inner segment, said segments being connected to each other at a point remote from the outside surface of a door but separated spaced apart at the point adjacent the outside surface of a door, said first part of said plate being provided with aligned buck pin apertures in said two segments forming said first part of said plate; a buck pin insertable through said aligned buck pin apertures and into the wall structure, said buck pin being provided with a head portion that abuts said outer segment of said first part of said plate and a grooved portion spaced from said head portion and adapted to align with the space between said two segments of said first part of said plate when said buck pin is inserted through said buck pin apertures with the head portion thereof abutting said outer segment of said first part of said plate; and a retaining member formed with an open ended slot adapted to be placed in the space between said segments of said first part of said plate with said slot engaging said groove in said buck pin to prevent removal of said buck pin.

2. Door security hardware according to claim 1 wherein said plate is provided with screwholes whereby said plate may be secured to a door jamb by screws.

3. Door security hardware according to claim 2 wherein said screwholes are provided in said second part of said plate whereby screws securing said plate to a door jamb will be covered by a closed door.

4. Door security hardware according to claim 2 wherein said screwholes are provided in the inner segment of said first part of said plate and clearance holes are provided in the outer segment of said first part of said plate in alignment with said screwholes, and wherein said retaining member blocks access to screws securing said plate to a door jamb.

5. Door security hardware according to claim 1 wherein said outer segment of said first part of said plate is provided with screwholes, and said security plate is provided with threaded screwholes whereby said retaining member may be fastened in place to avoid its inadvertent removal.

6. Door security hardware according to claim 1 wherein said first and said second parts of said plate are separate and wherein said second part of said plate is provided with an extension portion that extends into the space between the two segments of said first part of said plate, said extension portion being provided with an elongated slot that aligns with the buck pin apertures provided in said first part of said plate so that said first part of said plate may be adjustably located relative to said second part of said plate.

7. Door security hardware according to claim 6 wherein said second part of said plate is provided with screwholes for securing said first and second parts of said plate to a door jamb, and wherein the inner and outer segments of said first part of said plate are provided with elongated slots aligned with said screwholes.

* * * * *